US006361654B1

(12) United States Patent
Chuang et al.

(10) Patent No.: US 6,361,654 B1
(45) Date of Patent: Mar. 26, 2002

(54) AIR KNIFE ASSISTED SHEET TRANSFER

(75) Inventors: Strong C. Chuang, Appleton; Peter J. Allen, Neenah, both of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/560,254

(22) Filed: Apr. 26, 2000

(51) Int. Cl.[7] ..... D21F 11/00

(52) U.S. Cl. ..... 162/204; 162/202; 162/203; 162/218; 162/112; 162/111; 162/307; 162/306; 162/305; 162/275; 162/280

(58) Field of Search ..... 162/204, 202, 162/203, 218, 112, 111, 307, 306, 305, 275, 280

(56) References Cited

U.S. PATENT DOCUMENTS

| | | | | |
|---|---|---|---|---|
| 1,163,252 A | | 12/1915 | Millspaugh | |
| 1,581,656 A | | 4/1926 | Monaghan | |
| 2,255,951 A | | 9/1941 | Tomtlund | |
| 3,351,521 A | | 11/1967 | Murray et al. | |
| 3,981,084 A | | 9/1976 | Sobota | |
| 4,102,737 A | * | 7/1978 | Morton | 162/113 |
| 4,529,480 A | | 7/1985 | Trokhan | |
| 5,783,044 A | | 7/1998 | Schneider et al. | |
| 5,830,321 A | | 11/1998 | Lindsay et al. | |
| 5,958,190 A | | 9/1999 | Gregersen et al. | |

* cited by examiner

*Primary Examiner*—Stanley S. Silverman
*Assistant Examiner*—Mark Halpern
(74) *Attorney, Agent, or Firm*—Dority & Manning, P.A.

(57) ABSTRACT

A system and method for transferring a nonwoven web in a wet papermaking process to a fabric is disclosed. The system includes a vacuum shoe that operates in conjunction with a transfer shoe. The vacuum shoe is contacted against a carrier fabric which is designed to receive the nonwoven web. The transfer shoe, on the other hand, is configured to contact a transfer fabric from which the web is transferred. The transfer shoe includes an air nozzle which contacts the nonwoven web with a pressurized gas as the web is drawn towards the vacuum shoe. The system of the present invention is particularly well suited to processing lower basis weight webs and can be used in rush transfer processes.

22 Claims, 3 Drawing Sheets

AIR KNIFE ASSISTED SHEET TRANSFER

FIELD OF THE INVENTION

The present invention is generally directed to a system and process for transferring nonwoven webs from a first conveyor to a second conveyor in a wet papermaking process. More particularly, the present invention is directed to a process for transferring a paper web at a low solids consistency from a first fabric to a second fabric shortly after the web has been formed. In one embodiment, the nonwoven web is formed in between a first forming fabric and a second forming fabric and is transferred solely to the second forming fabric as the fabrics diverge.

BACKGROUND OF THE INVENTION

In making various paper products, typically an aqueous suspension containing pulp fibers is first formed. The aqueous suspension is then spread out over a forming surface in order to form a paper web. The forming surface generally includes a series of endless conveyors which are formed from a porous fabric that can be made from metal, plastic, or any other suitable material. The forming fabrics are designed to facilitate formation of the nonwoven web, to transport the nonwoven web, and to remove excess liquid from the web as it travels downstream.

In one embodiment, especially when forming low basis weight paper products such as tissues, the nonwoven web is formed in between a pair of forming fabrics. More specifically, in these systems, an aqueous suspension of fibers is injected on to one or in between a pair of moving fabrics as the fabrics are being wrapped around a roll, which is generally referred to as a forming roll. The forming roll assists in draining liquids from the web. These types of systems are typically referred to as "roll formers". Examples of roll formers include twin-wire systems and crescent-former systems.

From the forming fabrics, the nonwoven web is usually transported through a press section and then through one or more driers. Depending upon the paper product being formed, the nonwoven web can then be subjected to various post formation processes as desired.

One problem that is typically encountered during the formation of paper products is that the forming and transferring fabrics have a tendency to become fouled and clogged by bonding materials, additives contained within the fiber suspension, and especially, by paper fibers, which are not transferred to the next process such as press or drying sections and are referred to as "fiber carry back". Too much debris and fiber carry back on the fabric can create fiber waste and also can adversely affect sheet formation. The problems with fiber carry back become especially severe when the sheet being formed has a relatively low basis weight such as when making tissue paper, when short fibers at a low consistency are being used to form the paper sheet, at higher machines speeds, and when excessive amounts of fiber carry back begin to accumulate on the fabrics.

Fiber carry back typically occurs when a newly formed nonwoven web is transferred off of a forming fabric. As such, a need currently exists for a system and process for transferring a nonwoven web between fabrics that reduces fiber carry back. In particular, a need currently exists for an improved web transfer system that can efficiently transfer a newly formed nonwoven web at a low consistency or solids content from a first fabric to a second fabric without creating an unacceptable accumulation of fiber carry back. A need further exists for a nonwoven web transfer system for use in wet papermaking roll formers.

In the past, various systems and processes have been proposed that assist or facilitate the transfer of a nonwoven web from a first fabric to a second fabric. For instance, U.S. Pat. No. 5,830,321 to Lindsay. et al., which is incorporated herein by reference, discloses a method for improving the rush transfer of a nonwoven web between two separate fabrics that are moving at different speeds. Various features, aspects and advantages of the present invention, however, remain absent from the prior art as will be made apparent from the following description.

SUMMARY OF THE INVENTION

Accordingly, it is an object of the present invention to provide a process and system for transferring a nonwoven web between fabrics.

Another object of the present invention is to provide a system and process for transferring a nonwoven web to a moving fabric in a wet papermaking process while minimizing fiber carry back.

Still another object of the present invention is to provide a system and process for transferring a nonwoven web to a fabric using a vacuum shoe and an air knife.

These and other objects of the present invention are achieved by providing a nonwoven web transfer system and method for use in a wet papermaking process. The system includes a first fabric and a second fabric that are configured to receive a nonwoven web therebetween formed from an aqueous suspension of fibers. The first and second fabrics diverge whereby the nonwoven web is transferred solely to the first fabric.

In order to facilitate transfer to the first fabric, the system includes a vacuum shoe positioned against the first fabric at a location where the first fabric diverges from the second fabric. The vacuum shoe defines a vacuum slot configured to apply a suction force to the nonwoven web as the web is transferred to the first fabric.

A transfer shoe is positioned against the second fabric at a location generally opposite the vacuum shoe. The transfer shoe defines an air knife configured to deliver a pressurized gas against the nonwoven web as the web is being drawn towards the vacuum shoe. The air knife includes an air nozzle for emitting a pressurized gas.

Preferably, the second fabric is wrapped around the transfer shoe such that the second fabric forms an arriving angle and a departing angle with the transfer shoe. Further, the second fabric should be wrapped around the transfer shoe under sufficient tension such that the pressurized gas is forced through the fabric, as opposed to elevating the fabric off of the transfer shoe and allowing the air to flow around the fabric. In this regard, the tension place upon the fabric multiplied by the tangent of the departing angle should be greater than or equal to one half of the pressure of the gas being emitted by the air knife multiplied by the width of the gas channel.

The system and method of the present invention are particularly well suited for use in papermaking processes that produce low basis weight products, such as tissues. In this regard, the web transfer system of the present invention is well suited for use in roll forming systems. In these systems, an aqueous suspension of fibers is injected in between a first forming fabric and a second forming fabric as the fabrics are being wrapped around a forming roll. From the forming roll, the fabrics diverge and the base web is transferred solely to one of the fabrics.

As described above, the system of the present invention includes a vacuum shoe generally in alignment with a transfer shoe. In one embodiment, the leading edge of the gas channel is aligned with the leading edge of the vacuum slot. Further, for most applications, the vacuum slot can have a width greater than the width of the gas channel.

The gas that is emitted by the transfer shoe can be any suitable gas, such as air. The gas can be emitted at a pressure of at least 1 psi, and particularly from about 3 psi to about 15 psi.

The vacuum shoe and the transfer shoe generally include a convex surface which contacts the forming or transfer fabrics. In one embodiment, the vacuum shoe and the transfer shoe are stationary. The vacuum shoe and the transfer shoe can be made from various materials, including ceramics and plastics.

Other objects, features and aspects of the present invention are discussed in greater details below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Repeat use of references characters in the present specification and drawings is intended to represent same or analogous features or elements of the invention.

DETAILED DESCRIPTION OF THE PREFERRED EMBODIMENT

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a system and process for transferring a nonwoven web to a moving fabric in a wet papermaking process. The system of the present invention is particularly well suited to transferring newly formed nonwoven webs that are at a low consistency and at a low solids concentration. In particular, the system of the present invention is capable of transferring such webs in between forming fabrics and between forming to transfer fabrics while minimizing the amount of fiber carry back that remains on the fabric from which the web is transferred. In this regard, the system of the present invention is also particularly well suited for use in systems that have experienced severe fiber carry back problems in the past, such as in systems that form low basis weight webs, in systems that process short fibers at low consistencies, and in systems that run at higher speeds.

In general, the system of the present invention for transferring nonwoven webs in a wet papermaking process includes a first fabric for carrying a nonwoven web and a second fabric to which the web is transferred. In one embodiment, the nonwoven web can be formed from an aqueous suspension of fibers which is deposited in between the first and second fabrics. The fabrics diverge during which the nonwoven web is transferred solely to the second fabric.

In accordance with the present invention, in order to efficiently transfer the nonwoven webs, the system includes a vacuum shoe positioned against the fabric to which the web is transferred. The system also includes a transfer shoe positioned against the fabric from which the web is transferred. The transfer shoe is placed generally in alignment with the vacuum shoe. The transfer shoe includes an air nozzle which is designed to deliver a pressurized gas against the nonwoven web as the web is drawn towards the vacuum shoe. In this manner, low basis weight webs having a low consistency can be transferred to a moving fabric within a papermaking process, while minimizing the amount of fiber carry back that remains on the forming fabric from which the web is transferred.

Figure 1:
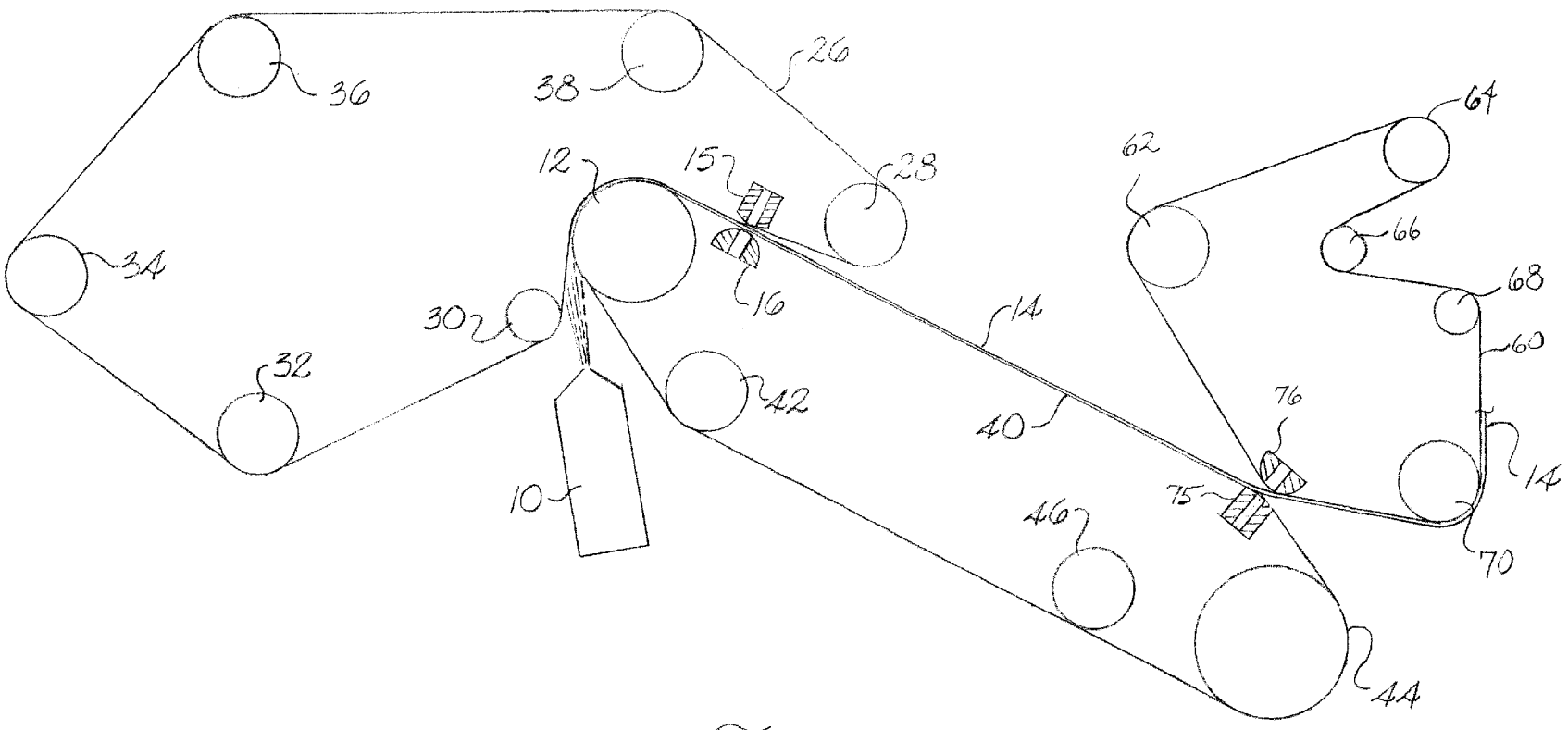
FIG. 1 is schematic diagram of one embodiment of a wet papermaking system made in accordance with the present invention.

Referring to FIG. 1, one embodiment of a papermaking system made in accordance with the present invention is illustrated. As described above, the system of the present invention is particularly well suited for use in systems that are designed to process products that contain small fibers at a low consistency, such as tissue products. In this regard, FIG. 1 generally illustrates a roll former system traditionally used to produce tissue products. Specifically, the system illustrated in FIG. 1 is generally referred to in the art as a twin-wire system.

As shown, the papermaking system includes a headbox 10 configured to receive a dilute aqueous suspension of papermaking fibers. Headbox 10 is configured to inject the aqueous suspension of fibers in between a first forming fabric 26 and a second forming fabric 40. As illustrated, first forming fabric 26 and second forming fabric 40 comprise endless traveling conveyors.

Forming fabric 26 is supported and driven by a plurality of rolls 28, 30, 32, 34, 36, and 38. Forming fabric 40, on the other hand, is supported and driven by rolls 42, 44, and 46. The speed at which fabric 26 is driven in relation to fabric 40 can depend upon the particular application. Typically, the speed at which fabric 40 is driven is approximately the same speed at which fabric 26 is driven so that movement of a nonwoven web through the system is consistent.

Forming fabrics 26 and 40 can be made from any suitable porous material, such as metal wires or polymeric filaments. Suitable fabrics can include, for example, Albany 84M and 94M available from Albany International of Albany, N.Y.; Asten 856, 866, 892, 959, 937 and Asten Synweve Design 274, available from Asten Forming Fabrics, Inc. of Appleton, Wis. The fabric can be a woven fabric as taught in U.S. Pat. No. 4,529,480 to Trokhan. Forming fabrics or felts comprising nonwoven base layers may also be useful, including those of Scapa Corporation made with extruded polyurethane foam such as the Spectra Series. Relatively smooth forming fabrics can be used, as well as textured fabrics suitable for imparting texture and basis weight variations to the web.

Other suitable fabrics may include Asten 934 and 939, or Lindsey 952–S05 and 2164 fabric from Appleton Mills, Wis. Additionally, novel three-dimensional fabrics comprising deformable nonwoven upper layers may be suitable.

As shown in FIG. 1, once the fiber suspension is injected between forming fabric 26 and forming fabric 40, the fabrics contact and wrap around a forming roll 12. Forming roll 12 is designed to assist in water removal and drainage. In one embodiment, forming roll 12 can be a vacuum roll which allows drainage through both of the forming fabrics.

Alternatively, however, forming roll 12 can be a solid roll, thus only allowing drainage through forming fabric 26.

After forming roll 12, forming fabric 26 diverges from forming fabric 40. As the fabrics diverge, a non-woven web 14 formed by the process becomes transferred solely to forming fabric 40.

The present invention is directed to a system for transferring non-woven web 14 to forming fabric 40 in a manner that minimizes fiber carry back. In this regard, the paper making system illustrated in FIG. 1 includes a transfer shoe 15 positioned against forming fabric 26 and a vacuum shoe 16 positioned against forming fabric 40. In general, vacuum shoe 16 applies a suction force through forming fabric 40 onto non-woven web 14 for drawing the web onto the forming fabric. Transfer shoe 15, on the other hand, includes an air nozzle which is configured to deliver a pressurized gas that contacts the non-woven web as the web is being drawn towards the vacuum shoe. Transfer shoe 15 facilitates transfer of the non-woven web to forming fabric 40 while also minimizing fiber carry back.

Figure 3:
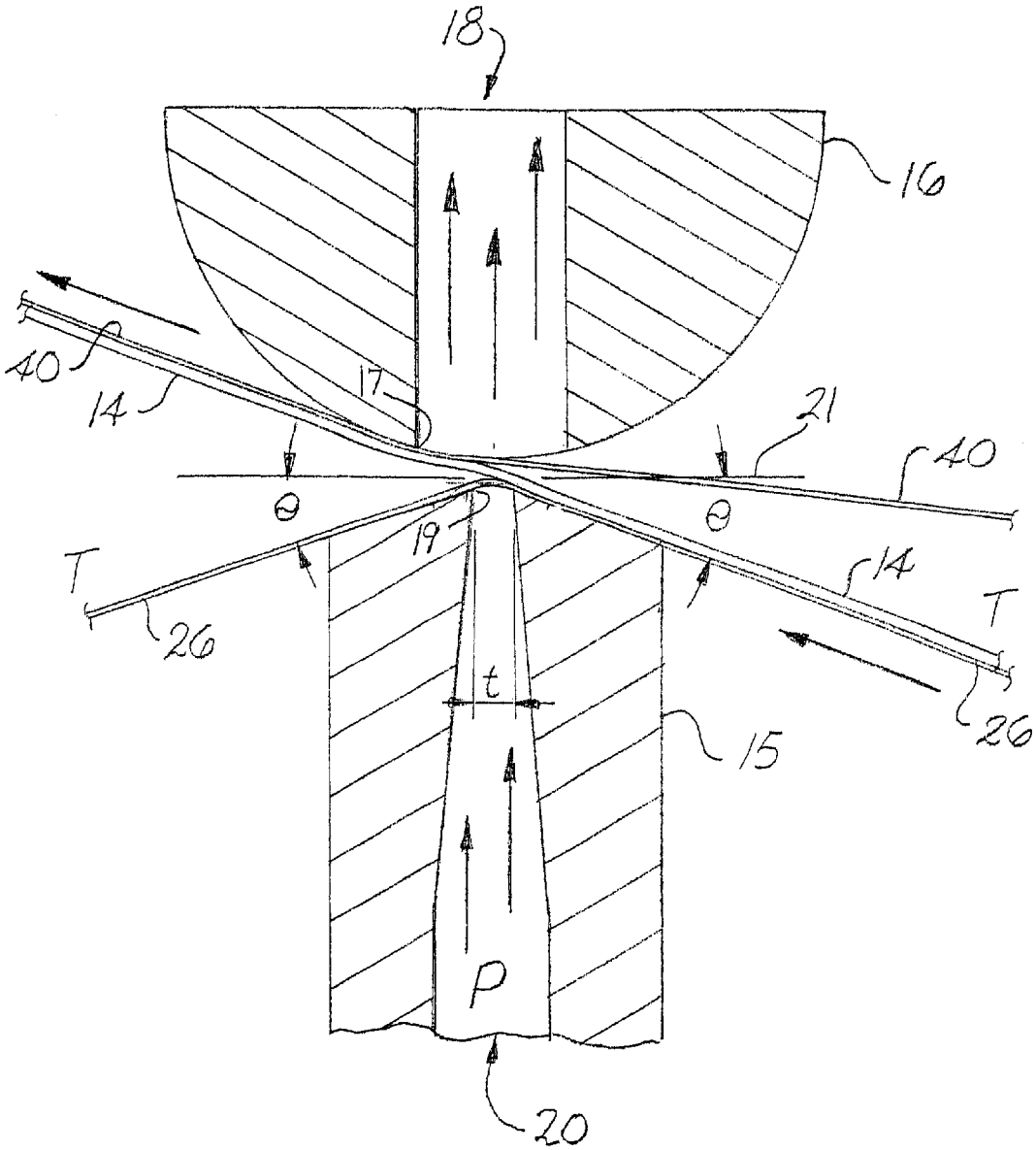
FIG. 3 is a side view with cut away portions of one embodiment of a web transfer system made in accordance with the present invention.

Referring to FIG. 3, a more detailed view of one embodiment of vacuum shoe 16 in conjunction with transfer shoe 15 is illustrated. As shown, transfer shoe 15 and vacuum shoe 16 define a convex surface which contacts the forming fabrics. For most applications, the transfer shoe and the vacuum shoe should be stationary and can be made from various materials, including ceramics and plastics.

Vacuum shoe 16 defines a vacuum slot generally 18 which extends the entire width of forming fabric 40. Vacuum slot 18 should be relatively narrow. In particular, the vacuum slot should have a width of less than about 3 inches, particularly less than about 1.5 inches, and more particularly, less than 0.5 inches. During operation, vacuum slot 18 is placed in communication with a vacuum device for applying a suction force to non-woven web 14.

As shown, transfer shoe 15 generally has a smaller radius of curvature than vacuum shoe 16.

As described above, transfer shoe 15 defines an air nozzle which includes a gas channel generally 20. Gas channel 20 is generally in the shape of a slot that extends the entire width of forming fabric 26. In one embodiment of the present invention, gas channel 20 is placed in alignment with vacuum slot 18. In particular, the leading edge 17 of vacuum slot 18 can be aligned with the leading edge 19 of gas channel 20.

Gas channel 20 is configured to be placed in communication with a pressurized gas source for emitting a pressurized gas against non-woven web 14. The gas can be, for instance, air.

Gas channel 20 of transfer shoe 15 should preferably have a narrow opening extending across the width of the web. For instance, the gas channel can have a width of less than about ½ inch, preferably less than about ¼ inch, and most preferably from about ⅛ inch to about ¼ inch in width. The width of gas channel 20 in FIG. 3 is represented by "t".

The pressure at which the gas is emitted from gas channel 20 will generally depend upon the particular application. For most applications, however, the gas should be at a pressure of at least 1 psi, and particularly from about 3 psi to about 15 psi.

Of particular importance with respect to the present invention, the system should be configured such that the gas being emitted by transfer shoe 15 passes through forming fabric 26 and contacts nonwoven web 14, instead of flowing around the forming fabric. In this regard, forming fabric 26 should have adequate wrap around transfer shoe 15 and should be under sufficient tension so that a seal forms between the fabric and the shoe causing the gas being emitted by the transfer shoe to be forced through the fabric. To satisfy this condition, the following equation governs:

$$2T\tan\theta \geqq pt$$

wherein:

T is the amount of tension placed on the forming fabric;

θ, with reference to tangent line 21, is less than or equal to the bevel angle between the fabric and the air nozzle on each side of the nozzle lips and is equal to one half of the fabric's turn angle when passing the air nozzle; θ is typically at least 2 degrees, and particularly from about 2 degrees to about 50 degrees;

p is the gas pressure; and t is the slot width of the air nozzle.

Besides being used to transfer webs between forming fabrics, the web transfer system of the present invention can also be used at other locations in the paper making process. For instance, as shown in FIG. 1, nonwoven web 14 once transferred to forming fabric 40 is then later transferred to a transfer fabric 60. As shown, transfer fabric 60 is supported and guided by rolls 62, 64, 66, 68 and 70. In accordance with the present invention, in order to facilitate transfer of nonwoven web 14 to transfer fabric 60, the system includes a vacuum shoe 76 in conjunction with a transfer shoe 75. Vacuum shoe 76 and transfer shoe 75 are similar in construction to vacuum shoe 16 and transfer shoe 15 described above. Specifically, vacuum shoe 76 applies a suction force to the nonwoven web, while transfer shoe 75 contacts the web with an air jet as the web is transferred to transfer fabric 60.

Transfer fabric 60 can move generally at the same speed as forming fabric 40. In one embodiment, however, transfer fabric 60 can move at a slower rate than forming fabric 40. This configuration causes web foreshortening in a process known as rush transfer. Rush transfer eliminates the stretching of the web and improves various properties of the web including the stretch properties. Rush transfer is particularly described in U.S. Pat. No. 5,830,321, which was referred to above.

It has been discovered that the transfer system of the present invention including vacuum shoe 76 and transfer shoe 75 provides various advantages and benefits during a rush transfer process. In particular, besides not only facilitating transfer of the nonwoven web from fabric 40 to fabric 60, the web transfer system of the present invention also improves the efficiency of a rush transfer process creating webs that have improved stretch characteristics and other improved physical properties.

Nonwoven web 14 used in the process of the present invention can be made with any suitable papermaking fibers, including fibers derived from wood, cotton, flax, hemp, bafasse, kenaf, and other natural materials, as well as mixtures of natural and synthetic fibers in an aqueous slurry.

Papermaking slurries can include various chemicals and particulates as is known in the art, including temporary and permanent wet strength resins; dry strength additives such as starches and cationic charged polymers; reactive dye components; polymeric retention aids, including bicomponent systems and systems involving silica, clays, and the like; mineral and organic fillers; opacifiers, including waxes and microspheres; softeners and debonders; and the like. Fibers may have been subjected to any number of mechanical, chemical, and thermal processing steps, including mechanical refining, chemical crosslinking, steam explosion, mechanical dispersing or kneading; oxidation or sulfonation; exposure to elevated temperature, etc.

The papermaking process illustrated in FIG. 1 is particularly well suited to producing low basis weight webs, such as facial and bath tissues. Tissue products typically have a relatively low basis weight and, depending upon the particular application, can contain relatively short fibers. Consequently, in these types of processes, errant fibers have a tendency to accumulate on the forming fabrics, particularly forming fabric 26 during the papermaking process. As described above, the transfer system of the present invention prevents theses unwanted fibers from accumulating on the forming fabric.

Figure 2:
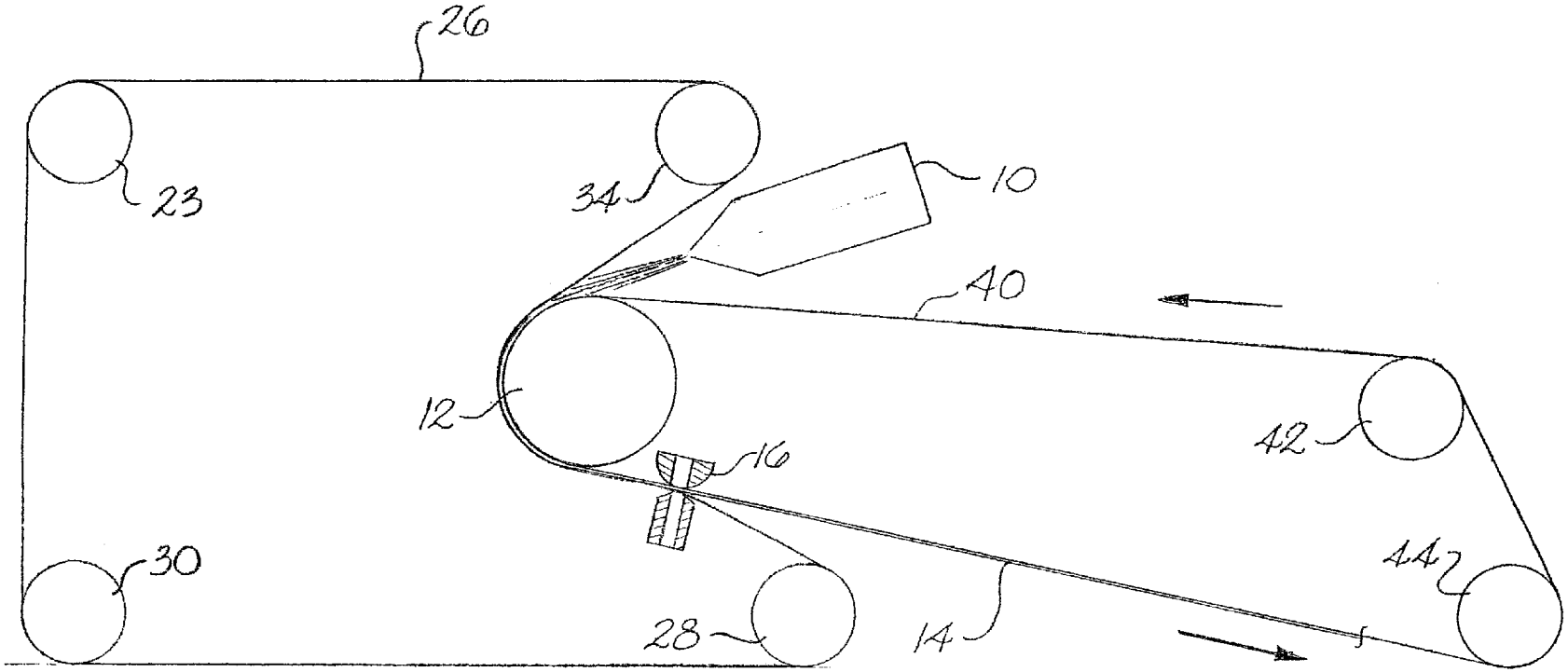
FIG. 2 is a schematic diagram of an alternative embodiment of a wet a papermaking system made in accordance with the present invention.

Referring to FIG. 2, an alternative embodiment of a papermaking system made in accordance with the present invention is illustrated. Similar character numerals have been used in order to indicate similar elements. This papermaking system is intended to represent a system known in the art as a crescent former.

As shown, the papermaking system includes a first forming fabric 26 and a second forming fabric or felt 40, which overlap around a forming roll 12. A headbox 10 is configured to inject a fiber suspension in between the forming fabrics for forming a nonwoven web.

As shown, nonwoven web 14 is transferred solely to felt 40 as felt 40 diverges from forming fabric 26. In accordance with the present invention, in order to facilitate this transfer, the system includes a vacuum shoe 16 and a transfer shoe 15 as described above.

In the systems illustrated in FIGS. 1 and 2, nonwoven web 14 typically has a consistency or a solids content of no greater than 20 percent. More particularly, the solids content of the web is typically from about 10 percent to about 12 percent during transfer to forming fabric 40. It has been discovered that even at these low consistencies, fiber carry back is substantially prevented through the use of vacuum shoe 16 and transfer shoe 15 as described above.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A nonwoven web transfer system for use in a wet papermaking process comprising:

a first moving fabric and a second moving fabric, said first and second fabrics being configured to receive a nonwoven web therebetween formed from an aqueous suspension of fibers, said first and second fabrics diverging whereby said nonwoven web is transferred solely to said first fabric;

a vacuum shoe positioned against said first fabric at a location where said first fabric diverges from said second fabric, said vacuum shoe defining a vacuum slot configured to apply a suction force to said nonwoven web as said web is transferred to said first fabric, said vacuum slot including a first leading edge and a first trailing edge;

a transfer shoe positioned against said second fabric at a location generally opposite said vacuum shoe, said transfer shoe defining an air nozzle configured to deliver a pressurized gas against said nonwoven web as said web is being drawn towards said vacuum shoe, said air nozzle comprising a gas channel for emitting said pressurized gas, said gas channel including a second leading edge and a second trailing edge, and wherein an opening defined by said gas channel is aligned to overlap with an opening defined by said vacuum slot, said second fabric being wrapped around said transfer shoe under sufficient tension such that said pressurized gas is forced through said fabric.

2. A nonwoven web transfer system as defined in claim 1, further comprising a headbox for injecting an aqueous suspension of fibers in between said first and second fabrics, and a forming roll positioned downstream from said headbox, said first and second fabrics being wrapped around said forming roll prior to diverging.

3. A nonwoven web transfer system as defined in claim 1, wherein the second fabric forms an angle between a tangent to the air nozzle and the second fabric, the angle from about 2 degrees to about 50 degrees.

4. A nonwoven web transfer system as defined in claim 1, wherein said air nozzle emits said pressurized gas at a pressure of at least 1 psi.

5. A nonwoven web transfer system as defined in claim 1, wherein said air nozzle emits said pressurized gas at a pressure of from about 3 psi to about 15 psi.

6. A nonwoven web transfer system as defined in claim 1, wherein the tension placed on said second fabric around said transfer shoe multiplied by the tangent of the angle is greater than or equal to one half of the pressure of the gas being emitted by the air nozzle multiplied by the width of the gas channel.

7. A nonwoven web transfer system as defined in claim 1, wherein said leading edge of said vacuum slot is aligned with said leading edge of said gas channel.

8. A nonwoven web transfer system as defined in claim 1, wherein said transfer shoe defines a convex surface that is contacted with said second fabric.

9. A nonwoven web transfer system for use in a wet papermaking process comprising:

a first moving fabric and a second moving fabric, said first and second fabrics being configured to receive a nonwoven web formed from an aqueous suspension of fibers, said nonwoven web being transferred from said second fabric to said first fabric;

a vacuum shoe positioned against said first fabric at a location where said first fabric diverges from said second fabric, said vacuum shoe defining a vacuum slot configured to apply a suction force to said nonwoven web as said web is transferred to said first fabric, said vacuum slot including a leading edge and a trailing edge;

a transfer shoe positioned against said second fabric at a location generally opposite said vacuum shoe, said transfer shoe defining an air nozzle configured to deliver a pressurized gas against said nonwoven web as said web is being drawn towards said vacuum shoe, said air nozzle comprising a gas channel for emitting said pressurized gas, said gas channel including a leading edge and a trailing edge, said transfer shoe being positioned so that the leading edge of the gas channel is aligned with the leading edge of the vacuum slot.

10. A nonwoven web transfer system as defined in claim 9, wherein said second fabric is wrapped around said transfer shoe such that the second fabric forms an angle with said transfer shoe that is from about 2 degrees to about 50 degrees.

11. A nonwoven web transfer system as defined in claim 9, wherein said second fabric is wrapped around said transfer shoe under sufficient tension such that a seal is formed between the fabric and the transfer shoe causing said pressurized gas to be forced through said fabric and against said nonwoven web.

12. A nonwoven web transfer system as defined in claim 11, wherein the tension placed on said second fabric around said transfer shoe multiplied by the tangent of the angle is greater than or equal to one half of the pressure of the gas being emitted by the air nozzle multiplied by the width of the gas channel.

13. A nonwoven web transfer system as defined in claim 9, wherein said vacuum slot is wider than said gas channel.

14. A nonwoven web transfer system as defined in claim 9, wherein said air nozzle emits said pressurized gas at a pressure of from about 3 psi to about 15 psi.

15. A nonwoven web transfer system as defined in claim 9, wherein said transfer shoe is stationary.

16. A nonwoven web transfer system as defined in claim 9, wherein said second fabric moves at a slower rate than said first fabric causing said nonwoven web to be foreshortened.

17. A process for forming and transferring a nonwoven web from a first moving fabric to a second moving fabric in a wet papermaking process, said process comprising the steps of:

injecting an aqueous suspension of fibers in between a first moving fabric and a second moving fabric to form a nonwoven web, said nonwoven web having a solids concentration of no greater than 20 percent, said first fabric diverging from said second fabric whereby said nonwoven web is transferred solely to said first fabric;

contacting said first fabric with a vacuum shoe, said vacuum shoe being positioned at a location where said first fabric diverges from said second fabric, said vacuum shoe applying a suction force to said nonwoven web as said web is transferred to said first fabric;

contacting said second fabric with a transfer shoe, said transfer shoe being positioned substantially aligned opposite said vacuum shoe, said transfer shoe defining an air nozzle which applies a pressurized gas against said nonwoven web as said web is being drawn towards said vacuum shoe, said second fabric being wrapped around said transfer shoe under sufficient tension such that said pressurized gas is forced through said fabric.

18. A process as defined in claim 17, wherein said air nozzle supplies a pressurized gas at a pressure from about 3 psi to about 15 psi.

19. A process as defined in claim 17, wherein said nonwoven web has a solids concentration of less than about 15 percent when transferred to said first fabric.

20. A process as defined in claim 17, wherein said nonwoven web has a solids concentration of from about 5 percent to about 12 percent when transferred to said first fabric.

21. A process as defined in claim 17, wherein an angle is formed between a tangent to the air nozzle and the second fabric that is from about 2 degrees to about 50 degrees, the tension placed on said second fabric around said transfer shoe multiplied by the tangent of the angle is greater than or equal to one half of the pressure of the gas being emitted by the air nozzle multiplied by the width of the gas channel.

22. A process as defined in claim 17, wherein said first fabric and said second fabric wrap around a forming roll after receiving said aqueous suspension of fibers and prior to diverging.

* * * * *